United States Patent [19]

Trueblood

[11] 4,141,062

[45] Feb. 20, 1979

[54] TROUBLE LIGHT UNIT

[75] Inventor: Raymond L. Trueblood, New Carlisle, Ohio

[73] Assignee: Trueblood, Inc., Tipp City, Ohio

[21] Appl. No.: 794,549

[22] Filed: May 6, 1977

[51] Int. Cl.[2] ..... F21L 15/12; F21V 15/00

[52] U.S. Cl. ..... 362/400; 362/344; 362/355; 362/378; 362/186

[58] Field of Search ..... 362/185, 189, 196, 202, 362/204, 205, 208, 376, 377, 378, 344, 399, 400, 457

[56] References Cited

U.S. PATENT DOCUMENTS

| | | | |
|---|---|---|---|
| 1,845,638 | 2/1932 | Wermine | 362/378 X |
| 2,554,565 | 5/1951 | Fike | 362/376 X |
| 2,677,753 | 5/1954 | Heinz | 362/344 |
| 2,729,740 | 1/1956 | Davis | 362/205 X |
| 2,735,930 | 2/1956 | Weight | 362/378 |
| 2,774,048 | 12/1956 | Baenzizer | 362/378 X |
| 2,861,175 | 11/1958 | Schweikle | D48/16 B |
| 3,119,568 | 1/1964 | Broder | 362/344 |
| 3,935,560 | 1/1976 | Dorn | 362/344 |
| 3,996,459 | 12/1976 | Schwartz | 362/344 |

*Primary Examiner*—Gerald Goldberg
*Assistant Examiner*—Peter S. Wong
*Attorney, Agent, or Firm*—Jerome P. Bloom

[57] ABSTRACT

A trouble light unit molded of plastic. One end of its tubular handle defines a receptable receiving a spacer block to which is slip-fit a lamp socket and switch device received and frictionally clamped in their required position as a diametral split in the outer end portion of the receptacle wall structure accommodates laterally projected portions of the included switch.

A sleeve-like insert applied in receptacle and portion of the handle forms substantially dead air space within its interior wall surface which insulates the body of the inserted lamp socket.

A preferred lamp or bulb cage for use with the handle which permits soft light to pass and provides vents including air flow facilitating the escape of heat.

The handle also incorporates plate-like projections which shield the switch operator and preclude direct impact thereof.

30 Claims, 7 Drawing Figures

TROUBLE LIGHT UNIT

BACKGROUND OF THE INVENTION

This invention relates to improvements in trouble light units and their component parts which make such units more economical to fabricate, more efficient and satisfactory in use and safer to operate.

In using trouble lights rough handling is often the rule rather than the exception. It is under such conditions that the conventional trouble light unit will usually exhibit its inherent faults. The following are examples of such faults.

Trouble lights are often dropped and it frequently occurs that the impact involves the operator of its included switch, a result of which is damage to the switch. Further, the portion of the trouble light unit which normally provides a female receptacle for connection of auxiliary equipment is normally subject to heavy wear in its use, making it difficult to insure, after a period of time, that the plug used to connect auxiliary equipment will be properly applied. Another problem found in use of prior art trouble lights is that their handles tend to quickly become hot, with obvious undesirable consequences. The same problem occurs in the case of a use of a lamp cage the form of which, for one reason or another, requires that it include a generally imperforate backing portion.

Apart from the foregoing problems, the conventional trouble light unit, as far as its handle and the relation thereto of an applied lamp socket and switch operator, provides an assembly which is not particularly economical to achieve or easy to assemble.

It was to the elimination of the above mentioned problems as well as hopes for improvement of individual components of trouble light units that the development efforts which resulted in the present invention were directed.

SUMMARY OF THE INVENTION

The present invention provides a composition of elements producing a trouble light unit which has a number of improvements. Embodiments feature an improved handle construction. The handle has a generally tubular configuration, one end of which defines a receptacle receiving a spacer block to which is slip fit a lamp socket and switch device mounting female terminal elements which are received and frictionally clamped in their required position by clips integrated with the spacer block. The frictional clamp of the terminal elements ties the lamp socket to the spacer block as a diametral split of the end portion of the handle which defines the receptacle accommodates the conventionally incorporated laterally projected operator of the included switch. The spacer block is designed to seat within the handle to position the female terminals in a direct alignment with slits in the wall of the handle. A reinforcing plate defining a polarity bridge is incorporated in the handle wall structure to form a part thereof and maintain the required configuration of the slits. The spacer block also includes, as an integrated part thereof, a ground terminal an opening to which is placed in alignment with an aperture in the wall of the handle which has a predetermined relation to the aforementioned polarity bridge and the slits of which it defines a part and forms therewith a guide for the prongs or blades of a plug serving as a means to electrically connect a tool to the power source of the trouble light.

The invention also contemplates the use of an insert which may be applied in the receptacle end portion of the handle to form dead air spaces with its interior wall surface serving to insulate the body of an inserted lamp socket. This inhibits a ready transmission of heat from the lamp socket device to the body of the handle.

A preferred embodiment of lamp or bulb cage for use in connection with the invention handle incorporates a generally imperforate backing or shield portion which permits a soft light to pass but in the main contains the light of the lamp or bulb which it backs. This cage is designed to incorporate optimally positioned vents to provide for and induce an escape of the heat developed by the caged lamp.

A feature of the preferred embodiment of the trouble light handle is a design configuration which minimizes the chance of damage to and relative displacement of its contained parts, particularly the switch component thereof.

It is accordingly a primary object of the invention to provide a trouble light unit and component parts thereof which are economical to fabricate and assemble, more efficient and satisfactory and safer in use.

Another object of the invention is to provide an improved handle for a trouble light unit which protects the contained parts from damage and relative displacement in the event of shock resulting from rough handling.

Another object of the invention is to provide a trouble light unit and component parts thereof which preclude danger from overheating in use thereof.

A further object of the invention is to provide a unique spacer block and features of an assembly thereof with a lamp socket, a connected switch and female terminals which lends ease and accuracy in assembling and positioning of the operative components of a trouble light within its handle.

An additional object of the invention is to provide a trouble light unit and component parts thereof possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein is shown one but not necessarily the only form of the embodiment of the invention, FIG. 1 is an exploded view of a trouble light unit illustrating component features per the present invention, FIG. 2 is a fragmentary cross sectional view of the trouble light of FIG. 1, assembled to illustrate practical and pertinent features of its components, FIG. 3 illustrates the receptacle portion of the trouble light handle, seen in FIG. 2, interiorly applied components being eliminated for clarity of disclosure, FIG. 4 is a view taken on line 4—4 of FIG. 3;

Figures 1, 2, 3, 4, 5, 6, 7:
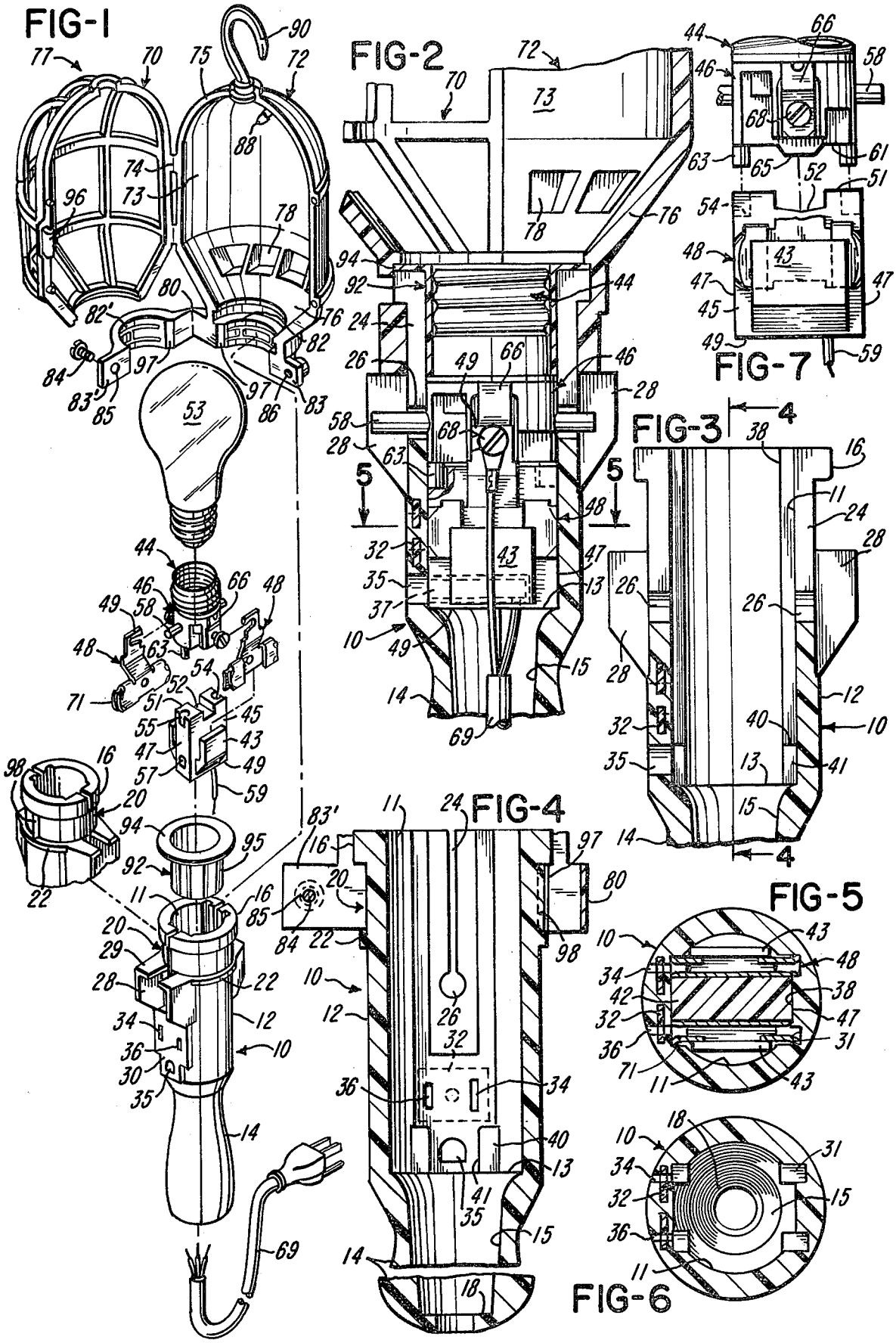
FIG. 5 is a view taken on line 5—5 of FIG. 2.
FIG. 6 is a view similar to FIG. 5 but with the interiorly contained parts being eliminated to illustrate details of the handle.
FIG. 7 is a fragmentary view exploded to illustrate the assembly of the switch and lamp socket of FIGS. 1 and 2 to the spacer block, to which they are frictionally coupled.

Like parts are indicated by similar characters of reference throughout the several views.

The preferred embodiments of the invention components herein described have the essential elements thereof, outside of those portions which must be conductive, molded of plastic.

The embodiment of a trouble light unit shown in the drawings comprises a generally tubular handle 10 approximately one-half portion of the length of which defines a receptacle 12 and the remainder a grip 14. An annular external flange 16 is formed integral with and peripherally of the end of the handle 10 which rims the opening to the receptacle 12 while the opposite end of the handle 10 is provided with an internal flange 18.

The interior wall surface 11 of that portion of the handle 10 which bounds the cavity of the receptacle 12 has a generally cylindrical configuration and its innermost end is defined by an internally projected annular shoulder 13 which faces outwardly of the entrance opening to the receptacle 12.

The portion 15 of the interior wall surface of that part of the handle 10 which defines the grip 14 is generally conically configured and convergent in the direction of the flange 18. The portion 15 extends from the inner periphery of the shoulder 13 to the outer periphery of the flange 18.

An external flange 22 is formed integral with and projected radially and circumferentially of and outwardly from the outermost surface of the receptacle 12, in an adjacent, spaced, parallel relation to the flange 16. The flange 22 has a lesser axial depth and radial projection than the flange 16 but it forms therewith a circumferential groove or channel 20.

The portion of the handle 10 defining the receptacle 12 is split by a pair of diametrically opposite slits 24 directed inwardly of the end including the flange 16, which slits extend approximately one-half the length of the receptacle wall structure. The innermost ends of the slits 24 terminate in expansions forming a pair of diametrically opposite apertures 26.

The outermost surface of the receptacle 12 has formed integral therewith two pairs of plate-like projections 28. The respective pairs of plate-like projections 28 are at diametrically opposite positions on the outer surface of the handle 10 and the elements of each pair are disposed in a parallel spaced relation to each other and to one of the slits 24 to have the aperture portion 26 thereof centered therebetween in both a lateral and a longitudinal sense. As may be seen with reference to the drawings, the plate-like projections of each pair are oriented to extend in a sense longitudinally of the handle 10, to merge at one end with the flange 22 and to have the opposite end, which is cut at an approximately 45° angle, directed inwardly to the body of the handle and in the direction of the grip 14 to merge with a block-like projection 30. The block-like projections 30 provide a relatively thickened portion of the wall structure of the receptacle 12 in each of the diametrically opposite locations where they occur and each has a generally T-shaped peripheral outline. In the preferred embodiment the handle 10 is formed, as previously noted, of plastic and prepared in a molding process. In the process of the molding there is embodied in the head portion of the T-shape of one of the block-like projections 30 a fiberboard, generally rectangular, plate-like insert 32. The insert 32 has a pair of parallel slots, respectively identified as 34 and 36, which in the placement of the insert extend in a sense longitudinal of the body of the handle 10, are differentially sized as to their length, and aligned with corresponding slots cut through the relatively thickened wall portion of the handle 10 in which the insert 32 is molded. As will be further described, the insert 32 defines a polarity bridge. Immediately beyond the insert 32, in the direction of the grip 14, the block-like projection 30 embodying the slits 34 and 36 has a through aperture 35 which is longitudinally spaced from and centered between the adjacent slits 34 and 36. The aperture 35 has a peripheral configuration such as that conventionally afforded on a grounding prong of a conventional grounding-type electrical plug.

The interior wall surface portion 11 of the receptacle 12 is provided with a pair of diametrically opposite grooves 38. Centered between the side walls of each groove 38 and generally parallel thereto is one of the slits 24. The grooves 38 which extend the length of the surface 11 are substantially uniform in width except at their innermost ends where they are reduced in width by rectangularly configured lateral projections 40 formed integral with their side walls. The aperture 35 is located to one side of the wall surface 11 within one of the grooves 38 in a position which is generally centered, both laterally and longitudinally, between the adjacent relatively spaced side walls 41 of projections 40.

The inner wall surface 11 of the receptacle 12 is configured as described to accommodate in slip fit relation thereto an assembly of a spacer block 42, a lamp socket 44 with a connected switch 46 and a pair of female terminals 48.

The basic body of the spacer block 42 has the configuration of a generally rectangular block including opposite faces 45, side walls 47, and end walls respectively designated as 49 and 51. The thickness of the body of the block 42 between its faces 45 is such to enable that the spacer block can be slip fit in the receptacle 12 to have its side walls 47 facing the bases of the respective grooves 38. In the slip fit of the spacer block 42 the end wall 49 is the leading wall and is directed inwardly of the receptacle until it abuts the shoulder 13 between the respective pairs of projections 40. The spacing between the facing sides 41 of the pairs of the projections 40 and their dimension is such that they immediately confine the opposite faces of the block 42 adjacent their lateral edges. Formed integral with each of the opposite faces 45 is a generally right angled wing-like projection 43 including a short leg which is molded integral with the face 45 and a longer leg which projects in the direction of the end 51 of the block in a generally parallel closely spaced relation to the adjacent face 45. The wing-like projections formed integral with the block 42 provide therewith friction clips the purpose of which will be further described. Note that the wing-like projections are centered between and spaced from the lateral edges of the faces 45 of which they form an integrated part and the connected ends of the wing-like projections are in spaced and generally parallel relation to the end wall 49 of the spacer block. The arrangement is such to facilitate the slip fit insertion of the spacer block to have the end thereof which positions innermost of the receptacle firmly nested and confined by the receptacle wall structure at the inner ends of the grooves 38.

The end wall 51 which positions outermost as the spacer block is inserted in the receptacle 12 has a rectangular notch 52 extending from face-to-face of the block and centered between its sides 47. Blind bores 54 are formed inwardly of the end wall 51 in the block 42, in a sense directed longitudinally thereof. The bores 54 are made so they intersect the side walls 47 the length of the bore so that in effect the configuration of each bore is that of a truncated cylinder, there being formed thereby lateral openings 55 in the ends of the side walls 47 adjacent the end 51 of the block 42. The end of the spacer block 42 which is first inserted in the receptacle 12 in the assembly thereof includes a further blind bore 57 directed inwardly of one side wall 47 in an adjacent parallel relation to the end surface 49. Molded within the block 42 which is fabricated of plastic or similar material in the preferred embodiment of the invention is a metallic liner to which is connected one end of a wire 59 constituting a ground lead which is also molded in the block 42 in the fabrication thereof in a manner believed obvious. As will be seen the wire 59 projects in order to effect a ground connection for an auxiliary tool applied in connection with the handle 10.

Prior to insertion of the spacer block 42 in the receptacle 12 there will be assembled thereto the parts 44, 46 and 48. The part 44 comprises a conventional lamp or bulb socket the nature and character of which is well known to comprise a metal threaded socket device into which a bulb 53 is adapted to be screwed to engage and make a contact in the base thereof, which contact is projected from the insulating body of the switch 46 connected to the socket device in end to end relation. As shown the switch 46 is a push button type switch of a conventional nature well known in the art and therefore its general detail will not be further described. Suffice it to say that the switch operator is a pin-like member 58 which extends through the insulating body or shell of the switch to have its ends project laterally thereof. The pin 58 incorporates a camming device whereby pushing thereof in one direction or another makes or breaks the switch 46. The switch 46 and the socket device 44 are of course suitably separated by an insulator, sandwiched therebetween, through which is projected the contact for the bulb to be applied in the socket device.

Now dealing more specifically with the elements of the switch pertinent to the present invention, the end of the insulating body of the switch 46 remote from the socket device 44 has a diametral portion which is relatively flatted, shown at 61 in the drawings. The diametral extremities of this flat 61, however, each have a perpendicularly projected cylindrical projection 63 providing a transversely spaced pair and at the portion of the flat 61 centered between the projections 63 is a further projection 65. The projection 65 is generally rectangular in a transverse sense and has its sides which face the adjacent projections 63 sloped so that they converge in a sense outwardly from the flat 61. The cylindrical projections 63 have a greater axial extent than the projection 65.

The projections 63 at the end of the insulating shell or body comprised in the switch 46 remote from the socket device 44 are adapted for an alignment with and slip fit in the bores 54 in the end 51 of the spacer block 42 as the notch 52 between the blind bores accommodates the projection 65.

The operative components of the switch 46 include a pair of terminals 66 including a threadedly connected relatively adjustable screw 68. The female terminals 48 referred to above are T-shaped and similar to the terminals 32 shown in FIG. 3 of the Baenziger U.S. Pat. No. 2,774,048, modified however in that the end of the leg portion which connects with the screw 68 has a hook 49 access to which is by way of a lateral notch in the leg of the T rather than the leg having a U-shaped configuration which opens upwardly as employed by Baenziger. The opening to the hook 49 enables that it may be slipped laterally over the body of a screw 68 and achieve a more positive electrical connection therewith. The head end of each T-shaped device 48 which is adapted to be inserted between a surface 45 and its wing-like projection 43 includes at the lateral extremities thereof an arrangement providing generally U-shaped springs 71 as in the Baenziger patent the respective leaves of which are urged towards each other against the influence of a normal bias tending to urge them to maintain their position as the leaves are slip fit between one of the faces 45 and the adjacent wing-like projection that defines therewith a friction clip.

For greatest ease of assembly the hook ends 49 of the female terminals 48 are moved laterally to receive the bodies of the screws 68, whereupon the screws are adjusted to clamp the hooks against the terminals 66. The construction of the hook portion 49 facilitates the application of the terminals to the switch and makes it extremely difficult to displace the hooks so as to cause them to lose contact with the terminals, once they are applied. After the terminals 48 are applied in connection with the terminals 66, the spacer block 42 is then slip fit in end abutting relation to the switch 46 to accommodate the projections 63 and 65 and at the same time have slip fit between its opposite faces 45 and the wing-like projections 43 the leafed ends of the terminals 48. As the respective leafed ends of the terminals 48 dispose between a face 45 and an adjacent wing-like projection 43, the leaf portions thereof are urged towards each other to have a spacing which is that precisely desired for a firm slip fit of the blade or prong of an electrical plug.

In its application in the receptacle 12, the side walls 47 of the block 42 are oriented to face the bases of the grooves 38 with the lateral edges of the faces 45 being disposed between the side walls thereof. As is obvious, the end wall 49 forms the leading edge of the block 42, upon its insertion. The application of the assembly including the spacer block, the socket device and connected switch in the pocket defined by the receptacle 12 is facilitated by the insertion of the laterally projected ends of the pin-like operator 58 in the slits 24.

The split portions of the receptacle created by the slits 24 are resiliently connected by means of their configuration and the material of which the handle is formed, so they spread as required but snap back together as the ends of the operator 58 move into the apertures 26. This occurs as the end wall 49 of the spacer block seats to the shoulder 13 between the adjacent side walls 41 of the projections 40, the latter of which provide the reductions in width of the innermost ends of the grooves 38. Simultaneous with the seating of the spacer block, the ground bore 57 and the U-shaped springs 71 at adjacent side portions of the head ends of the terminals 48 line up, respectively, with the aperture 35 and the slits or slots 34 and 36.

It is noted that there is a further groove 31 at each of the opposite lateral edges of the base of each groove 38. The grooves 31 function to facilitate the ready passage of the lateral extremities of the head ends of the leaf portions of the terminals 48 as the spacer block and its assembled parts are moved inwardly of the pocket defined by the receptacle 12.

As will be obvious from the drawings, a cable 69 is inserted through the aperture defined by the flange 18 to have the wires thereof electrically connected, respectively, by conventional attachment, to the terminals 66. The timing of these connections and of the grounding wire 59 and the application thereof is believed obvious and appear to require no further explanation.

Particular attention is directed to the fact that each of the plate-like projections 28 on the outer surface of the receptacle portion 12 of the handle 10 has a right angled extension 29 merged with and forming a radial projection co-planar with the flange 22 of which it forms an integrated part. In respect to the elements of each pair of the diametrically opposite pairs of projections 28 the right angled extensions 29 in connection therewith are directed inwardly towards each other to terminate just short of the slit 24 which is positioned therebetween. A particularly significant aspect of the assembly of the spacer block, switch and lamp socket device just described to the handle 10 is that as it is properly guided and seated in and to the handle 10, within the pocket defined by the receptacle 12, the ends of the switch operator 58 which project through the apertures 26 will project from the outer surface of the basic body of the receptacle to a lesser degree than the plate-like projections 28 and their right angled extensions 29. Accordingly, the switch operator 58 is bounded on three sides by plate-like projections and ready access thereto for manipulation thereof is provided only from the direction of the grip 14. The arrangement is such that on the one hand the construction avoids a serious problem of the prior art in that the switch operator is essentially fully protected against direct impact with a surface against which the handle unit may be dropped or bumped. Moreover, it will be seen that the thumb or forefinger, depending on the circumstances, of a hand firmly applied to the grip 14 by reason of its contour may be readily moved up and between the plate-like projections 28, from the direction of the grip, for a simple and convenient manipulation of the switch operator.

A further feature of an assembly of a preferred embodiment of a handle unit per the present invention will provide that after insertion into the handle unit of the assembly comprising parts 42, 44 and 48, and prior to the application of a bulb 53 in the socket device 44, a sleeve element 92, made of plastic, is inserted in the open end of the pocket provided by the receptacle 12. This sleeve-like element is positioned about and concentric to the socket device 44 and is slightly longer than the socket 44, considering its axial length. In the process of the application of the sleeve, an external flange 94 formed integral with its outermost end positions over and in abutment with the outer end of the flange 16. The outermost surface of the sleeve 92 has a generally uniform external diameter but intermediate the ends thereof this surface is formed with a series of longitudinally extending, longitudinally tapered grooves which define therebetween a series of narrow circumferentially spaced shallow ribs 95. The ribs 95 are relatively shallow as to their depth and the taper is such that the depth of the ribs is greatest adjacent the flange 94 and practically disappears at the end of the sleeve remote from this flange. The construction provides that in the application of the flanged sleeve 92 substantially dead air space is defined between the ribs, the base of the grooves formed in the outer surface of the sleeve and the surface 11 of the receptacle 12. The spaces thus provided between the ribs are capped to one end by the flange 94 while they are substantially capped to the other end by reason of the fact that the outer surface of the sleeve at this end is substantially free of projection and essentially totally bears on the surface 11. In any event, the application of the sleeve is such to create an insulating wall structure including relatively dead air space in bounding relation to the metal socket device 44. This precludes the ready transmission of heat from the socket device to the handle structure by reason of the extended use of an applied bulb. The safety feature thus provided is believed obvious.

A preferred bulb guard 77 molded of plastic is used in connection with the handle unit of the present invention to achieve a most advantageously constructed trouble light which can be safely employed. The guard 77 is mounted to the handle 10 by means of a diametrally split, relatively narrow, cylindrical band which seats about the base of the groove 20 and between the flanges 16 and 22. This band comprises two semi-cylindrical 180° segments 82 and 82', respectively having co-planar radially projected ears 83 and 83' at their diametral extremities. The segment 82 is formed as the extremity of an integral axial extension of one end of an axially elongated bowl-like shade 72 to one longitudinally extending side of which is hinged a cage 70 which has a similarly shaped bowl-like form. The cage 70 is connected to the shade 72 by a pair of integrally formed longitudinally spaced thin webs which define a hinge 74.

The edges of the open sides of the shade 72 and the cage 70 which align and abut as the cage is closed on the shade 72 are each formed by a peripheral rib presenting a flat surface at its abutting side. As the cage is closed on the shade it produces therewith an axially elongated bulb-like shell. The shape of this shell provides it with a cylindrical form intermediate its ends, a hemi-spherical form at its end remote from the mounting band 82, 82' and a frusto-conical form at the opposite end. The latter end terminates in a split ring which locates about and in spaced relation to the neck of the bulb 53 when the guard is installed.

The band segment 82 is relatively thickened as to its wall structure and has the radially projected end of one ear 83 integrally connected with the projected extremity of one of the ears 83' on the band part 82', the latter of which is free of and axially spaced from the adjacent end of the cage 70. The integrally connected ears 83 and 83' have formed therebetween a narrow practically unobservable web 80 which forms a spring-type hinge between the segments 82 and 82'. The arrangement is such to normally urge the segment 82' to swing away from a closed abutting relation to the segment 82. The ears 83, 83' on the relatively free extremities of the band segments 82, 82' are respectively provided with a through aperture 85 centered in one free ear and adapted on a facing abutment of the free ears to align with a threaded blind bore 86 in a thickened portion of the other free ear.

Referring to FIG. 1 of the drawings, it will be seen that the innermost surfaces of the band segments 82, 82' each have a projecting rib structure adapted to seat and bear about and against the outer surface of the base of the groove 20 in the application of the mounting band to the handle 10. This rib structure includes axially spaced ribs which are quite narrow and extend the major portion of the arcuate extent of the inner surface of the band segments. These axially spaced ribs are interconnected at spaced locations by transversely disposed ribs. The arrangement of this interiorly projected rib structure gives a substantial grip effect as the mounting band is applied to the handle.

Of particular consequence is the fact that the radially innermost edge portions of the ears 83, 83' which are directly connected to form a spring hinge each have an identical chamfer 97. The mating of these chamfers as the band is closed forms a pocket which is complementary in shape to that of a male projection 98 located on the outer wall surface of the handle 10, between the flanges 16 and 22 and at a location spaced 90° from the slits 24. It will be readily seen that the projection 98 and the complementary notch provided by mating of the chamfers 97 will enable that in the application of the band in the groove 20 the orientation of the guard 77 with reference to the handle will be predetermined and fixed. As the band segment 82' is closed on the segment 82 to effect a fixing thereof to and about the handle, the segments are clamped together through the medium of a screw 84 applied through the aperture 85 in the free ear 83' to threadedly engage in the blind bore 86 of the other free ear 83.

The cage 70 is conventionally formed of longitudinally and transversely extending intersecting curved ribs anchored at their extremities to the peripheral rib bounding the open side of its bowl-like shape. While the cage is essentially an open framework, the shade has the semi-cylindrical and semi-hemispherical portion thereof solid and impermeable and the frusto-conical segment thereof likewise impermeable except for four circularly spaced vent holes 78 in a part thereof which is angled inwardly and under the cylindrical contoured intermediate portion of the shade. Note that the shade is formed of plastic wall structure of a thickness and type adapted to transmit a diffused soft light from the bulb 53 which it shields.

To complete the guard 77 there is rotatably secured in the peak of the portion of the hemispherical end of the guard included in the shade the flanged base of a projected hook structure 90. The peak of the mating cage portion 70 is formed so that in the closure of the cage it provides a notch to fit about the neck of the hook device immediately above its flange base. This structural arrangement is conventional and therefore not further described.

To secure the cage in a closed position, its peripheral rib is formed with a hook-like projection 96 which is adapted to snap fit over a facing portion of the peripheral rib about the open side of the shade 72. A similar but reversely facing hook 88 is integrated with the peripheral rib of the shade 72 and adapted on closure of the cage to snap under and about a portion of its peripheral rib, adjacent the peak thereof which closes about the neck of the hook 90.

The foregoing provides what is believed to be a comprehensive disclosure of preferred embodiments of a trouble light in accordance with the present invention as well as details of improvements of its component parts. As should be obvious, the invention prescribes a very simple formulation for fabricating a trouble light assembly wherein the assembly of the component parts is achieved essentially by slip fit of one component to another. The novelly constructed spacer block not only facilitates a ready tie of the operative elements but it clamps the leaves of the terminal elements in a form and position to insure positive contact on application of a plug. This feature of the invention is enhanced by the polarity bridge provided in the body of the handle per se. The handle, by reason of its slit construction, further facilitates an easy and economical assembly of a trouble light unit. A simple but most important feature is the containment of the switch operator by the projections 28 and 29, avoiding the incidence of the often occurring switch damage evidenced in use of prior art trouble light units. The arrangement of the plate projections 28 and 29 dictate, moreover, that one can use the basic trouble light unit and manipulate the operator of the switch in an extremely simple fashion while gripping the portion 14. Add to the foregoing the sleeve 92 which by reason of its configuration provides important protective insulation for the lamp socket and you have an assembly where there need be no concern for burns and other problems by reason of the handle unit becoming unduly hot.

The details per se of the guard 77 also lend improvements in the art. The spring relation of the parts of the band structure insure a quick and positive disassembly of the band and thereby of the guard from the handle unit as and when necessary. Also, the rib configuration on the interior of the band 82, 82' insures a proper and firm grip of the handle when applied and the male-female connection afforded as between the band structure and the handle in the application of the guard lends certainty to the fixture of the guard with reference to the handle. All this contributes to a highly desirable shape and configuration for a trouble light assembly wherein all components are given maximum protection in use. Particular attention is directed to the fact that the shade 72 is not a reflector but arranged for a soft diffusion of light, giving a better light environment for the user of the structure. The positioning of the vents in an angularly inclined portion of the guard 77 afford an arrangement wherein air may be drawn and induced to move behind the light and over the inner surface of the imperforate portion of the shade to and from the openings provided by the cage construction.

The aforementioned features and details thereof are emphasized as lending improvement in the art which is exemplified in the following references representing prior art:

| | | |
|---|---|---|
| 1,435,133 | J. A. Amos-E. Wanamaker | Nov. 7, 1922 |
| 1,735,295 | R. H. Olley | Nov. 12, 1929 |
| 1,843,418 | E. O. Ericson | Feb. 2, 1932 |
| Re. 20,033 | F. W. Hudson | July 14, 1936 |
| 2,567,687 | G. B. Benander | Sept. 11, 1951 |
| 2,626,347 | L. N. Baenziger | Jan. 20, 1953 |
| 2,774,048 | L. N. Baenziger | Dec. 11, 1956 |
| 2,855,501 | J. A. Wasselle | Oct. 5, 1958 |
| 3,036,209 | J. A. Wasselle | May 22, 1962 |
| 3,183,348 | M. R. Porter | May 11, 1965 |
| 3,308,289 | E. R. Conradi | March 7, 1967 |
| 3,755,668 | Moreschini | Aug. 28, 1973 |
| 3,814,927 | Buzza | June 4, 1974 |
| 3,935,560 | Dorn | Jan. 27, 1976 |

From a careful study on the part of applicant, the prior art as represented by the above listed references does not appear either in individual content or in combination to provide the novel features of the present invention which have been enumerated by way of description of a preferred embodiment of the present invention and its various features.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A trouble light handle comprising a wall structure forming a substantially tubular body the form of which defines a pocket to accommodate in one end thereof a bulb socket device and a connected switch, the interior surface of the wall structure of the tubular body defining said pocket including a groove of longitudinal extent central to which is a longitudinally extending slit opening through the wall structure of said body, the inner end of which slit is expanded to produce an aperture adapted to accommodate the projection therethrough of a portion of a switch operator in connection with a switch inserted in said pocket, the outer surface of said handle being formed with projecting means bounding said aperture, said projecting means being constructed and arranged to shield a projected switch operator from direct impact with a surface against which the handle may be bumped or dropped, the end of said handle remote from said pocket being formed exteriorly thereof to provide a hand grip, and said projecting means being constructed and arranged to provide access, from the direction of the grip, for a thumb or forefinger of a hand applied to the grip to reach and to manipulate the switch operator, and to provide access from the opposite direction for a switch operator to reach said aperture through said slit upon insertion of a switch into said pocket.

2. A trouble light handle as in claim 1 including, in connection with said body, means defining a polarity bridge configured to have slots therein of different shape and size which position in alignment with openings in a wall portion of said body which communicates with said pocket, said slots and the configuration thereof, together with said aligned openings affording passages the peripheral configuration of which is limited by the slots in said bridge to insure a proper application therein of the prongs of an electrical plug.

3. A trouble light handle as in claim 2 wherein the body of said handle is formed of plastic, said polarity bridge is a fiber reinforced plate embodying said slots and the wall structure of said body includes an aperture which is triangularly positioned with reference to said slots and communicates with the interior of said pocket to accommodate the projection therethrough of a grounding prong of an electrical plug, the other prongs or blades of which are accommodated by said slots.

4. A trouble light handle as in claim 1, wherein said interior surface of the wall structure of the tubular body which defines said pocket includes a pair of said grooves of longitudinal extent which are diametrically opposite, central to each of which grooves is a longitudinally extending slit with expanded inner end adapted to accommodate the projection therethrough of a portion of a switch operator, and said bounding projecting means are formed at each of opposite sides of said handle and at each of said sides are similarly constructed and arranged for access therethrough from opposite directions along said handle.

5. A trouble light handle as in claim 4, wherein said diametrically opposite grooves in the interior wall structure of said body have portions acting as controlling guides as well as positioning means for the slip fit and positioning of an assembly including said socket device and connected switch in said pocket.

6. A trouble light handle as in claim 5, wherein said slip fit assembly includes a spacer block mounting said socket device and said switch and guided by said-grooves into a set position in said pocket.

7. A trouble light handle as in claim 6, wherein said spacer block, said socket device and said switch form an assembly of connected parts inserted as a unit into said pocket and said block has means for frictionally gripping terminals embodied in said switch for a proper positioning thereof within said pocket.

8. A trouble light handle unit as in claim 1 wherein said pocket is lined by means forming therein dead air space, providing thereby for an insulation of an inserted lamp socket which inhibits the transmission of heat to the exterior of the handle.

9. A trouble light unit comprising a lamp socket device and a switch in end to end relation, said switch including a laterally projected switch operator, a spacer block, a generally tubular wall structure defining a body one end of which forms a pocket, said spacer block and said switch having a male-female mount, one to the other, and having a slip fit in said pocket to position said socket device to nest therein and to open outwardly from the opening to said pocket, the wall structure of said body forming said pocket being provided with means forming a pair of slots which are differentiated as to their size and open to said pocket in line with female terminals in connection with said switch, said spacer block being slidably accommodated in said pocket and being confined against relative angular motion therein, and said spacer block having means for fixing said female terminals to maintain them positioned for positive contact thereof by prongs of an electrical plug inserted through said slots.

10. A trouble light unit as in claim 9 wherein the wall structure of said body defining said pocket includes a pair of diametrically opposite slits opening at one end from the end of said wall structure which defines the opening to said pocket and having their opposite and innermost ends relatively expanded, said slits providing thereby for an accommodation of the movement of the laterally projected portion of said switch operator as said spacer block, said switch and said lamp socket device are slip fit in said pocket, and said expanded portions of said slits define the location desired for the laterally projected portion of said switch operator when the lamp socket device, said switch and said spacer block are properly located in said pocket.

11. A trouble light unit as in claim 10 wherein the interior wall surface of said pocket is formed with grooves which guide and properly orient said spacer block in the application thereof in said pocket and include abutment means for said spacer block to insure the proper positioning of said switch and socket device within said pocket.

12. A trouble light unit as in claim 11 wherein means are inserted between said socket device and the interior wall surface of said pocket to define dead air space insulating said handle in use thereof.

13. A trouble light unit as in claim 11 wherein the expanded portion of each said slit is bounded by plate-like means formed integral with and projected from the exterior surface of the wall structure defining said pocket, said slit extending through said plate-like means to the relatively expanded portion thereof, and said plate-like means leaving an opening on one side providing that on grip of the end of said body remote from the opening to said pocket the thumb or forefinger of the hand applied to the grip may be readily applied to a projected end portion of said switch operator to make or break the switch, said plate-like means being so formed and configured to protect the switch operator from contact with a surface against which said unit may be forcibly impacted.

14. A trouble light unit as in claim 13 wherein the exterior surface of said body is provided with longitudinally spaced, circumferentially directed and outwardly projected flanges defining therebetween a groove adapted to receive the collar of a bulb cage and including therein means for engagement with the collar to fix the position thereof in said groove.

15. A trouble light unit as in claim 14 wherein a cylindrical band is applied to said handle having in connection therewith and forming an integral part of a bulb guard, said band being disposed within said groove and being clamped to the base of said groove, between said longitudinally spaced flanges, and said band and the base of said groove being provided with male-female indexing means which fixes said band and the connected guard against rotation relative to said handle once said band is applied.

16. Apparatus as in claim 15 wherein said band is comprised of two semi-cylindrical segments of plastic including, at one pair of adjacent ends thereof a radially projected ear on each of said adjacent ends, which ears are integrated at their radially projected extremities to form a spring hinge therebetween urging one of said segments to swing outwardly from the other and the ends of said segments remote from said ears including means for interconnection thereof against the influence of said spring hinge.

17. A trouble light unit as in claim 14 mounting a bulb guard, said bulb guard including a cylindrical band fixed to and about the base of said groove and said guard including a bowl-like shade anchored at one end to a portion of said band and being formed to include a backing for a bulb applied in said socket device which is constructed to softly diffuse the light from the bulb which it backs.

18. Apparatus as in claim 17 wherein a cage is integrally connected to said shade by hinge means and said shade includes, in a portion thereof adjacent that portion of the band to which it connects, a plurality of vents providing for a directed air flow to move over the inner surface of said shade adjacent said bulb and to and from said guard by way of said cage.

19. A bulb guard including a mounting band, a shade and a cage, a portion of said shade being formed to provide an imperforate shield adapted to be positioned in a backing relation to a bulb, said cage being connected with and hinged to said shade and constructed and arranged to be moved to a capping relation to said shade to form therewith a shell-like enclosure for said bulb, and said shade being of a substance and thickness to softly diffuse light from the bulb which it backs.

20. A bulb guard as in claim 19 wherein said shell-like enclosure includes a frusto-conical shaped extremity including a surface portion of said shade which is angularly related to the central axis of said enclosure and includes a plurality of vent openings providing a path for air to move over the inner surface of said shade, to the rear of the bulb which it backs and to and from said enclosure by way of openings in said cage.

21. A bulb guard as in claim 19 wherein said mounting band includes a pair of semi-cylindrical segments one pair of adjacent ends of which are directly connected by an integral web structure arranged to apply a bias to normally swing one of said segments outwardly from the other.

22. A bulb guard as in claim 21 wherein said pair of adjacent ends of said segments each include an outwardly projected ear and the outwardly projected extremities of said ears are directly connected to define said web.

23. A bulb guard as in claim 22 wherein the surfaces of said band segments which dispose innermost in the application thereof include relatively projected ribs which serve a gripping function in the application of said band.

24. A bulb guard as in claim 19 wherein said shade has a semi-conically shaped neck adjacent said band which expands inwardly from said band to merge with said imperforate shield portion, and said neck is imperforate except for a plurality of side-by-side apertures providing for movement of air upwardly thereof over said imperforate shield portion and about the bulb contained by said guard.

25. A trouble light unit, comprising a lamp socket, a switch and a spacer block in end to end relation, said spacer block having a friction fit therewith of terminals in connection with and projected from said switch, a handle portion having at one end thereof an open pocket receiving said spacer block, said switch, and said socket, the interior of said pocket being configured for an interfitting relation with said spacer block to limit and confine said spacer block on its introduction to said pocket, and said handle portion having electrical prong accommodating slots with which said switch terminals are inherently aligned on the insertion of said spacer block into said pocket.

26. A trouble light unit as in claim 25, wherein said switch positions intermediately of said socket and said spacer block and seats to said spacer block, said switch and said spacer block have interfitting portions obviating relative angular turning motion therebetween, said switch has a laterally projected switch actuator, said handle portion has at least one switch actuator accommodating slit opening through said one end thereof, and the confinement of said spacer block in said pocket inherently positions said switch, in a rotary sense, to align the switch actuator with said slit.

27. A trouble light unit as in claim 26, wherein a bulb guard positions on said handle portion to form a generally axial extension of said one end thereof, said guard includes a mounting band in embracing relation to said handle portion, said band being separated into half portions integrally joined together at one end to define a hinge and having projecting ears at their opposite ends adapted to be releasably connected to one another and said band is made of a material allowing its half portions to flex about said hinge.

28. A trouble light unit as in claim 27, the handle portion exterior having a projection thereon at a location embraced by said mounting band, said band portions including configurations engageable with said projection to inhibit said bulb guard from rotating relative to said handle portion.

29. A trouble light unit as in claim 25, wherein a sleeve mounts in said open pocket in a following relation to the assembly comprised of said spacer block, said switch and said socket, said sleeve being arranged in a position to surround said lamp socket, and being in a substantially mutually contacting relation to said lamp socket and the surrounding wall surface of said pocket, and said sleeve having grooves therein defining air spaces between said socket and said surrounding pocket wall surface.

30. A trouble light unit as in claim 29 wherein said grooves taper, in longitudinal sense, from a minimum depth toward the inner end of said sleeve to a maximum depth toward the outer end thereof.

* * * * *

UNITED STATES PATENT AND TRADEMARK OFFICE

CERTIFICATE OF CORRECTION

PATENT NO. : 4,141,062

DATED : February 20, 1979

INVENTOR(S) : Raymond L. Trueblood

It is certified that error appears in the above-identified patent and that said Letters Patent are hereby corrected as shown below:

In the ABSTRACT, line 14, "including" is corrected to read -- inducing --.

Column 10, line 27, -- as -- is inserted following "certainty".

Column 14, line 27 (Claim 24, line 3), "inwardly" is corrected to read -- upwardly --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*